US009394724B2

(12) United States Patent
Herdman

(10) Patent No.: US 9,394,724 B2
(45) Date of Patent: Jul. 19, 2016

(54) LOCKING DEVICE FOR MOUNTING AND SECURING AN ARTICLE

(71) Applicant: Rodrick A. Herdman, West Chester, OH (US)

(72) Inventor: Rodrick A. Herdman, West Chester, OH (US)

( * ) Notice: Subject to any disclaimer, the term of this patent is extended or adjusted under 35 U.S.C. 154(b) by 0 days.

(21) Appl. No.: 14/699,298

(22) Filed: Apr. 29, 2015

(65) Prior Publication Data

US 2015/0308160 A1 Oct. 29, 2015

Related U.S. Application Data

(60) Provisional application No. 61/985,631, filed on Apr. 29, 2014.

(51) Int. Cl.

| | |
|---|---|
| ***E05B 37/16*** | (2006.01) |
| ***E05B 73/00*** | (2006.01) |
| ***F41A 17/04*** | (2006.01) |
| ***F41A 17/46*** | (2006.01) |
| *E05B 37/00* | (2006.01) |

(52) U.S. Cl.

CPC ..... *E05B 37/16* (2013.01); *E05B 73/00* (2013.01); *F41A 17/04* (2013.01); *F41A 17/46* (2013.01); *E05B 37/00* (2013.01)

(58) Field of Classification Search

CPC . E05B 37/00; E05B 37/0048; E05B 37/0051; E05B 37/0068; E05B 37/16; E05B 37/163; E05B 37/166; E05B 67/00; F41A 17/04; F41A 17/46; F41A 17/54

See application file for complete search history.

(56) References Cited

U.S. PATENT DOCUMENTS

| | | | | |
|---|---|---|---|---|
| 2,000,111 A * | 5/1935 | Weis | E05B 37/16 292/357 |
| 2,034,997 A * | 3/1936 | Soper | E05B 37/16 70/1.7 |
| 2,558,619 A * | 6/1951 | Lehman | E05B 37/16 70/295 |
| 2,640,346 A | 6/1953 | Giffin | |
| 2,893,152 A | 7/1959 | Peluso | |
| 3,099,150 A * | 7/1963 | Check | E05B 37/166 70/133 |
| 3,192,746 A | 7/1965 | Lehman | |
| 3,256,723 A | 6/1966 | Lehman | |
| 3,422,646 A | 1/1969 | Monahan | |
| 3,435,647 A * | 4/1969 | Le Blanc | E05B 37/163 70/214 |
| 3,462,981 A * | 8/1969 | LeBlanc | E05B 37/163 70/156 |

(Continued)

FOREIGN PATENT DOCUMENTS

| | | |
|---|---|---|
| EP | 0000003 A1 | 12/1978 |
| WO | 9737190 A1 | 10/1997 |

OTHER PUBLICATIONS

International Search Report and Written Opinion dated Sep. 15, 2014, for related International Application No. PCT/US2014/027715, filed Mar. 14, 2014 (11 pages).

(Continued)

*Primary Examiner* — Christopher Boswell

(74) *Attorney, Agent, or Firm* — Hasse & Nesbitt LLC; Daniel F. Nesbitt

(57) ABSTRACT

A mounting and securing device for a handgun or other article. The device has a cylindrical locking member that is securable to a post. Radially-extending change pins disposed in the sidewall of the locking member engage and move a plurality of control pins axially within pin bores. A tumbler disposed between each control pin and the central post is moved into and out of engagement with a groove in the post, in response to the axial movement of the control pin.

19 Claims, 14 Drawing Sheets

(56) References Cited

U.S. PATENT DOCUMENTS

| | | | | | |
|---|---|---|---|---|---|
| 3,648,492 | A | | 3/1972 | Walter et al. | |
| 4,012,931 | A | | 3/1977 | Harunan | |
| 4,191,035 | A | * | 3/1980 | Hatch | E05B 37/16 70/298 |
| 4,575,141 | A | * | 3/1986 | Burns | E05B 13/002 292/336.3 |
| 4,621,510 | A | | 11/1986 | Scherbing | |
| 4,718,260 | A | * | 1/1988 | Larking | E05B 37/16 70/299 |
| 4,787,224 | A | | 11/1988 | Mesa | |
| 4,794,768 | A | | 1/1989 | Moser et al. | |
| 4,799,371 | A | * | 1/1989 | Duncan | E05B 37/16 70/214 |
| 5,400,538 | A | | 3/1995 | Shannon | |
| 5,417,000 | A | | 5/1995 | Chen | |
| 5,704,152 | A | * | 1/1998 | Harrison | F41A 17/54 42/70.07 |
| 5,829,280 | A | | 11/1998 | Chen | |
| 6,055,759 | A | | 5/2000 | Langner | |
| 6,272,784 | B1 | | 8/2001 | Ringers | |
| 6,357,271 | B1 | | 3/2002 | Hsu | |
| 6,382,002 | B1 | | 5/2002 | Chen | |
| 6,487,803 | B1 | | 12/2002 | Yu | |
| 6,550,299 | B1 | | 4/2003 | Lin | |
| 6,560,910 | B1 | | 5/2003 | McLaren | |
| 6,718,678 | B2 | | 4/2004 | Riebling et al. | |
| 6,718,808 | B2 | | 4/2004 | Yu | |
| 7,021,095 | B2 | | 4/2006 | Jensen | |
| 2004/0118172 | A1 | | 6/2004 | Nall | |
| 2005/0199027 | A1 | | 9/2005 | Mannella | |
| 2008/0184748 | A1 | | 8/2008 | Burmesch | |
| 2011/0036129 | A1 | | 2/2011 | Frantz | |

OTHER PUBLICATIONS

International Search Report and Written Opinion dated Nov. 19, 2014, for related International Application No. PCT/US2014/049337, filed Aug. 1, 2014 (10 pages).

* cited by examiner

LOCKING DEVICE FOR MOUNTING AND SECURING AN ARTICLE

CROSS-REFERENCE TO RELATED APPLICATIONS

This application claims the benefit of U.S. Provisional application 61/985,631, filed Apr. 29, 2014 (pending), the disclosure of which is incorporated by reference in its entirety.

FIELD OF THE INVENTION

The invention relates to a locking device for securing a firearm or other article of value or requiring security or safekeeping.

BACKGROUND OF THE INVENTION

The owners and users of certain articles, including a handgun, jewelry, and other valuables including documents, and noxious products and compositions, want to have the article ready for use or access at any or all times, but need to maintain the article in a safe condition or state of operation away and out of access to other persons, including friends, family members, children, guests and the like.

SUMMARY OF THE INVENTION

The present invention provides a lock device for securing an article, including: a locking member that locks to a securing member, the securing member including a post having a groove along a circumference of the post, the locking member including a body having an axis, a front face, and a rear face, and a sidewall, the body having a post bore along the axis and through the rear face that is configured to accept the distal end of the post, a plurality of pin bores displaced from the post bore, a plurality of radial tumbler channels extending between each pin bore and the post bore, a plurality of change pin bores, each change pin bore intersecting one of the plurality of pin bores, and a plurality of button openings in the sidewall each button opening in communication with one of the plurality of change pin bores; a change pin disposed in each change pin bore, the change pin having a body, a first end having a slanted surface, and including a button at a second end disposed within one of the plurality of button openings in the sidewall, of the body, the change pin moveable within the change pin bore between a first position biased toward the sidewall, and a second depressed position when the button end is depressed wherein. the first end extends into the corresponding one of the plurality of pin bores; a control pin disposed in each pin bore, the control pin having a body, a first end and an opposed second end, the first end having a slanted surface, and having a control pin recess formed in the body intermediate the first end and second end, the control pin moveable within the pin bore between a first position biased toward the front face, and a second depressed position disposed rearwardly from the first position; and a tumbler disposed within each tumbler channel, configured for radial movement within the tumbler channel within at least one of the groove of the post when disposed within the post bore, and the control pin recess, wherein when the change pin is depressed to its second depressed position, the slanted surface of the change pin slidingly engages the slanted surface of the control pin, and biases the control pin to its second depressed position.

The present invention also provides a lock device for securing an article, including: a locking member that locks to a securing member, the securing member including a post having a groove along a circumference of a distal end of the post, the locking member including a body having an axis, a front thee, and a rear thee, and a sidewall, the body having a post bore along the axis and through the rear face that is configured to accept the distal end of the post, a plurality of pin bores displaced from the post bore, a plurality of radial tumbler channels extending between each pin bore and the post bore, a plurality of change pin bores, each change phi bore intersecting one of the plurality of pin bores, a plurality of front button openings in the front face of the lock member, each face button opening in communication with one of the plurality of pin bores, and a plurality of side button openings in the sidewall each side button opening in communication with one of the plurality of change pin bores; a radial change pin disposed in each change pin bore, the radial, change pin having a body, a first end having a slanted surface, and a second end disposed within one of the plurality of button openings in the sidewall of the body, the change pin moveable within the change pin bore between a first position toward the sidewall, and a second depressed position wherein the first end extends into the corresponding one of the plurality of pin bores; a control pin disposed in each pin bore, the control, pin including a body having a first end and an opposed second end, a control pin recess formed intermediate, the first end and second end, and a slanted surface formed intermediate the first end and control pin recess, the control pin moveable within the pin bore between a first position, biased toward the front face, and a second depressed position disposed rearwardly from the first position; an axial change pin having a first end and an opposed second end, the first end including a button that extends through the front button opening in the front face of a lock member; a button spring disposed in compression between the first end of the control pin and the second and of the axial change pin; and a tumbler disposed within each tumbler channel configured for radial movement within the tumbler channel within at least one of the groove of the post when disposed within the post bore, and the control pin recess, wherein when the radial change pin is depressed to its second depressed position, the slanted surface of the radial change pin slidingly engages the slanted surface of the control pin to bias the body of the control pin to its second depressed position, and when the button of the axial change pin is depressed, the second end of the axial change pin drives the body of the control pin to its second depressed position.

An aspect of the invention includes wherein the slanted surface can include a slanted line, a beveled surface, and a curved surface.

An aspect of the invention provides that the tumbler can consists of two or more balls.

Another aspect of the invention provides that the control pin body is cylindrical and the control pin recess is a circumferential recess.

Another aspect of the invention provides that the change pin bores are bored through the sidewall of the body, and further including a cylindrical cover secured to the body, and having a sidewall having the side button openings in registry or alignment with the change pin bore.

An aspect of the invention further provides a spring within each control pin bore at the second end of the control pin that biases the control pin toward the front face.

A further aspect of the invention provides that the side button openings have a reduced diameter relative to the diameter of the change pin bore.

A further aspect of the invention is a plate secured to the rear face of the locking device that extends radially outwardly from the outer periphery of the locking device.

Yet another aspect of the invention provides that the locking member has a slot extending axially and inwardly from the post bore into the body of the locking member, and the post includes an axially-arranged rib extending along its periphery for registry with the slot, as a means for preventing relative rotation of the body of the locking member about the post.

An aspect of an embodiment of the invention provides that the second, end of the axial change pin captures a first end of a control spring, and the first end of the control pin captures a second end of the control spring.

DETAILED DESCRIPTION OF THE INVENTION

A mounting and securing device for a handgun or other article. The device has a cylindrical locking member that is securable to a post. Radially-extending change pins disposed hi the sidewall of the locking member engage and move a plurality of control pins axially within pin bores. A tumbler disposed between each control pin and the central post is moved into and out of engagement with a groove in the post, in response to the axial movement of the control pin.

Figure 1:
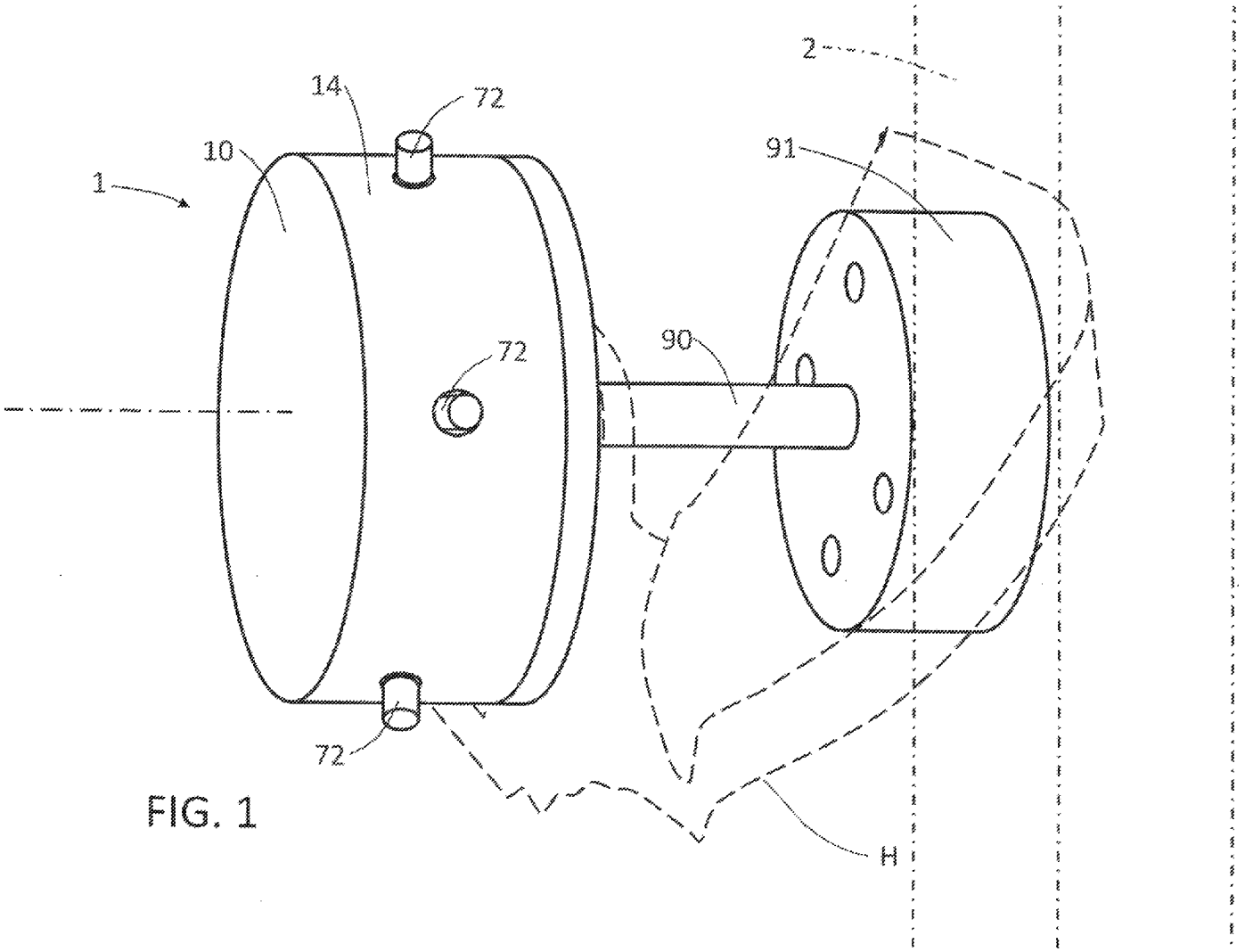
FIG. 1 shows a lock device of the invention, including a posh-button locking member and a post for securing a handgun.
Figure 2:
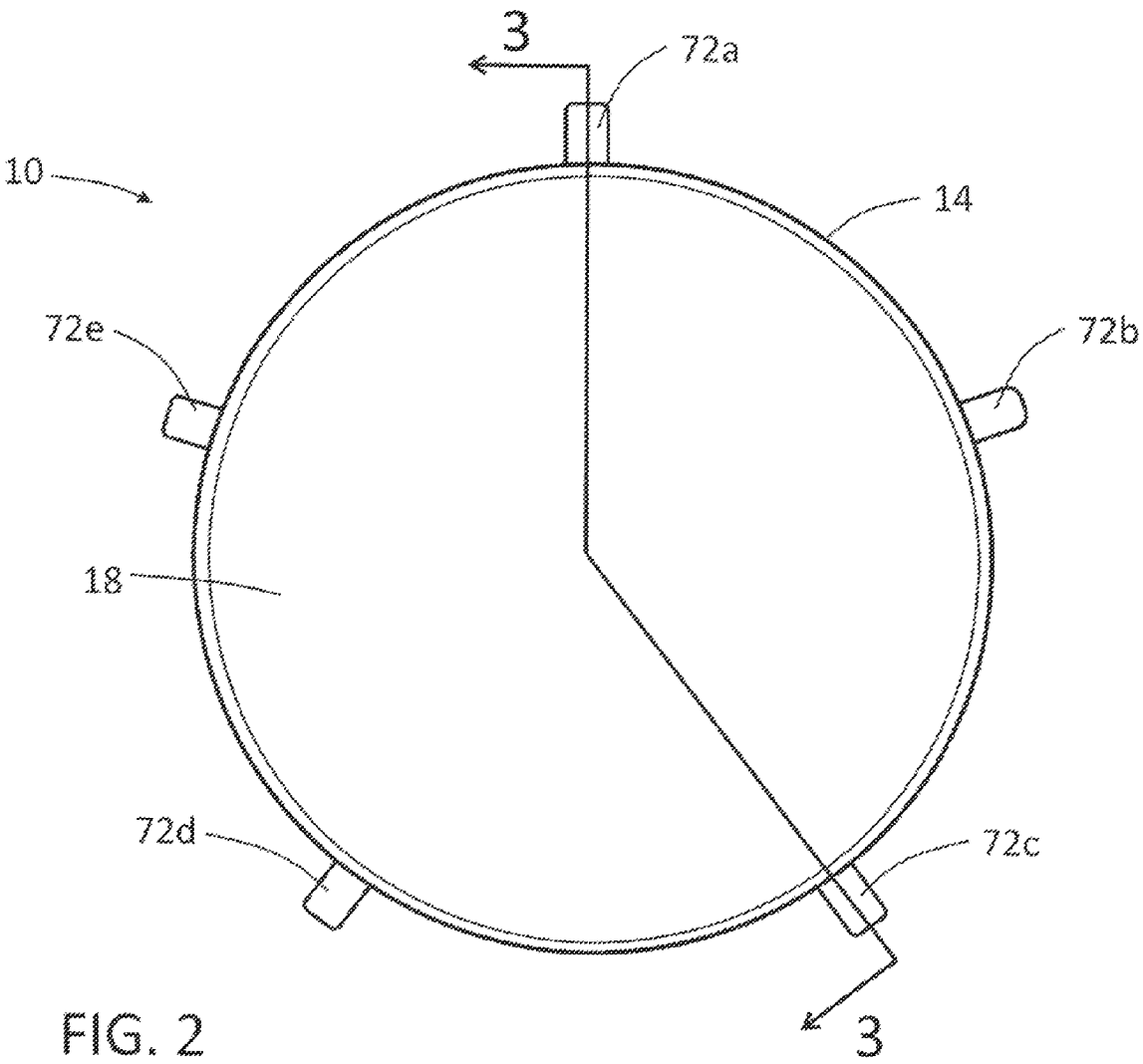
FIG. 2 shows a front view of the locking member.

FIG. 1 shows a lock system 1 of the present invention for a device or an article, illustrated as a handgun. The system includes a push-button locking member 10, and a post 90 onto which the locking member 10 is securable. The post 90 can be secured to an immovable structure or fixture, including a structural wooden stud in the wall of a home, office or other building, or a moveable structure or fixture, including a gun case, dresser drawer, cabinet or cabinet doors, furniture, storage locker, a holster, a gun rack, a storage box, a glove box or storage compartment, in an automobile, truck or other motor vehicle, etc, The illustrated embodiment shows the post 90 affixed to, or made integral with a base 91 that can be secured to a wooden stud 2 in the wail of a home or apartment with a fastener (not shown), such as wood screws, nails, etc. An object or article, including but not limited to a handgun as illustrated, is secured by placing the object or article over the end of the post 90, and securing it thereto by installing and locking the locking member 10 over the end of the post 90. FIG. 2 shows a front view of the locking member having a plurality of depressable buttons 72 extending from the circumferential sidewall.

Figure 3:
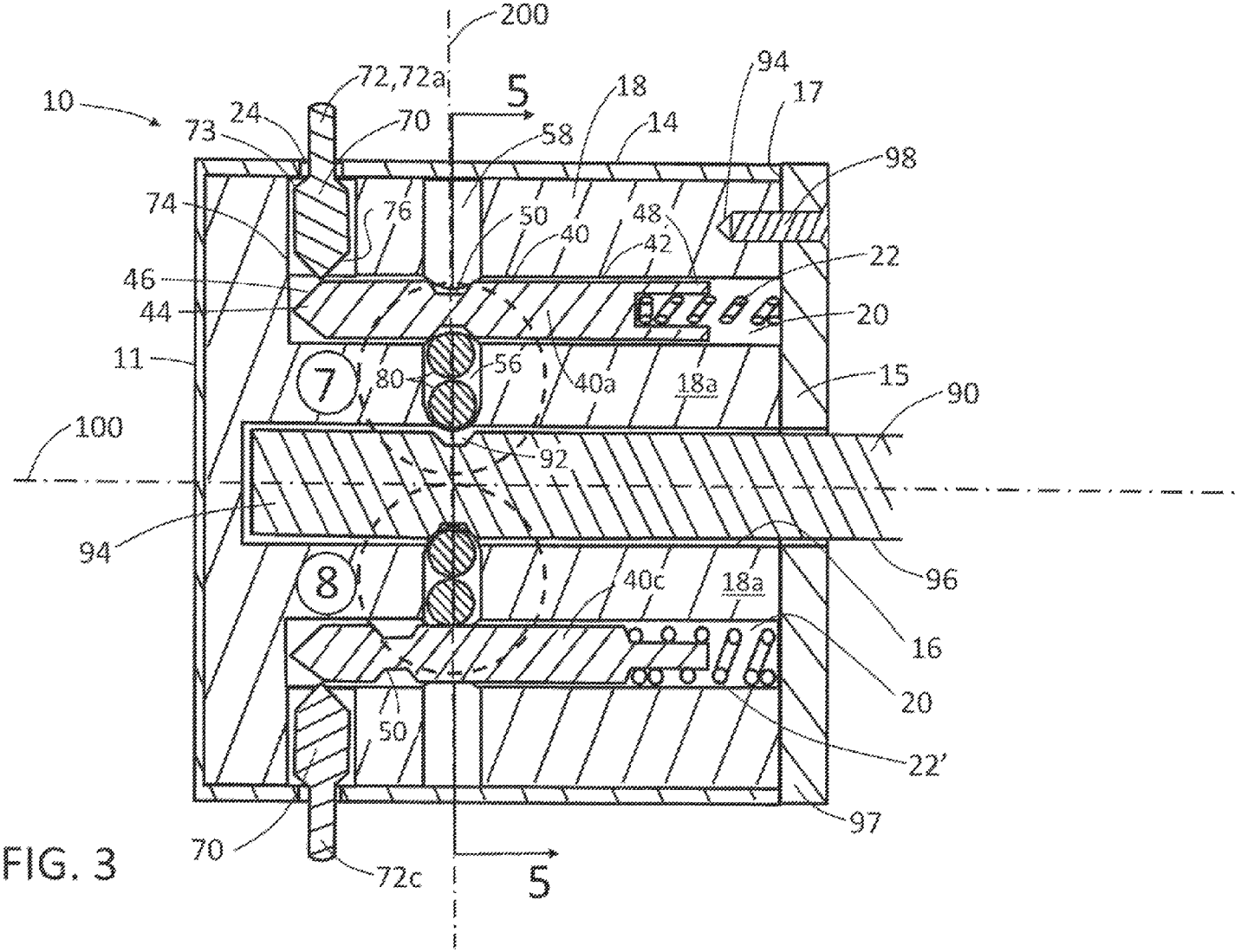
FIG. 3 shows a section view of the securement device through line 3-3 of FIG. 2, illustrating two control pins and associated change pins in unbiased positions.

FIG. 3 is a section view of the locking member and post, through two of the buttons shown in FIG. 2. The push-button locking member 10 has a body, illustrated as a cylindrical body 18, with an axis, illustrated as a central axis 100, and has a circumferential wall 14 through which a plurality of depressable button(s) 72 extend and a rear face or surface 15 having a post bore therethrough, illustrated as a cylindrical central bore 16, onto which the post 90 is installable and securable. The push button 72 extends radially outwardly from an elongated change pin 70, which is moveable radially within change bores 74 formed within the body and extending into communication with the pin bore 20 of an associated change pin 40. Each change pin 70 is engagingly associated with a control pin 40 that is moveable axially within the pin bore 20, with the plurality of pin bores arranged around the post bore, illustrated as central bore 16, at equal spacing, both radially from the central axis 100 and circumferentially from one another (see FIG. 5). The change pin bores 74 are disposed axially forwardly, toward the front face of the body 18, thereby intersecting a distal end of their associated control pin bores 20, and the distal end 44 of the control pins 44 disposed therein.

Alternatively, each of the plurality of control pin bores 40 can be disposed at a distance from the post bore 16 that is the same or different; if different, the tumbler channel and tumbler(s) lengths, described herein after, are selected accordingly. Each control pin 40 is biased to a forward first position within the pin bore 20 with a biasing means, illustrated as a spring 22, disposed at the second end 48 of the control pin 40. The spring 22 can be a compression spring that is disposed within a recess, as shown for control pin 40*a*, or can be a spring 22' that is anchored over a central end pin of control pin 40*c*.

Each control pin 40 includes a body having a periphery along its length and in cross section, illustrated as a cylindrical body having a periphery 42, and a first or driven end 44, which is biased toward the distal end of the control bore 20 by the spring 22 to a biased-forward first position. A recess 50 is formed into the periphery 42 intermediate the first end 44 and second end 48. As illustrated, the recess 50 can extend around the entire circumference of the control pin 40 to form a circumferential recess. The recess 50 and its center are disposed a selected fixed distance from the first end 44 of the control pin 40.

The control pin 40 also includes a beveled surface 46 at the driven first end 44. The beveled surface 46 is configured to be oriented facing radially outwardly, facing toward the change pin bore 74 in its biased-forward first position. In the illustrated embodiment, the beveled surface is a conical surface whereby a beveled surface will face the change bore 74 regardless of the rotational position of the control pin 40 within the control pin bore 20.

Each change pin 70 includes a body having a push-button end and a drive end. The push-button end includes the reduced-diameter push button 72 that extends from a shoulder 73, through an opening 24 in the circumferential sidewall 14. The drive end includes a beveled surface 76 configured to face in at least one radial direction. The change pin 70 can be disposed in the change pin bore 74 with the bevel surface 76 facing down the length of the control pin bore 20. In the illustrated embodiment, the beveled surface is a conical surface whereby a beveled surface will face the control pin bore 20 regardless of the rotational position of the radial change pin 70 within the change pin bore 74.

Figure 4:
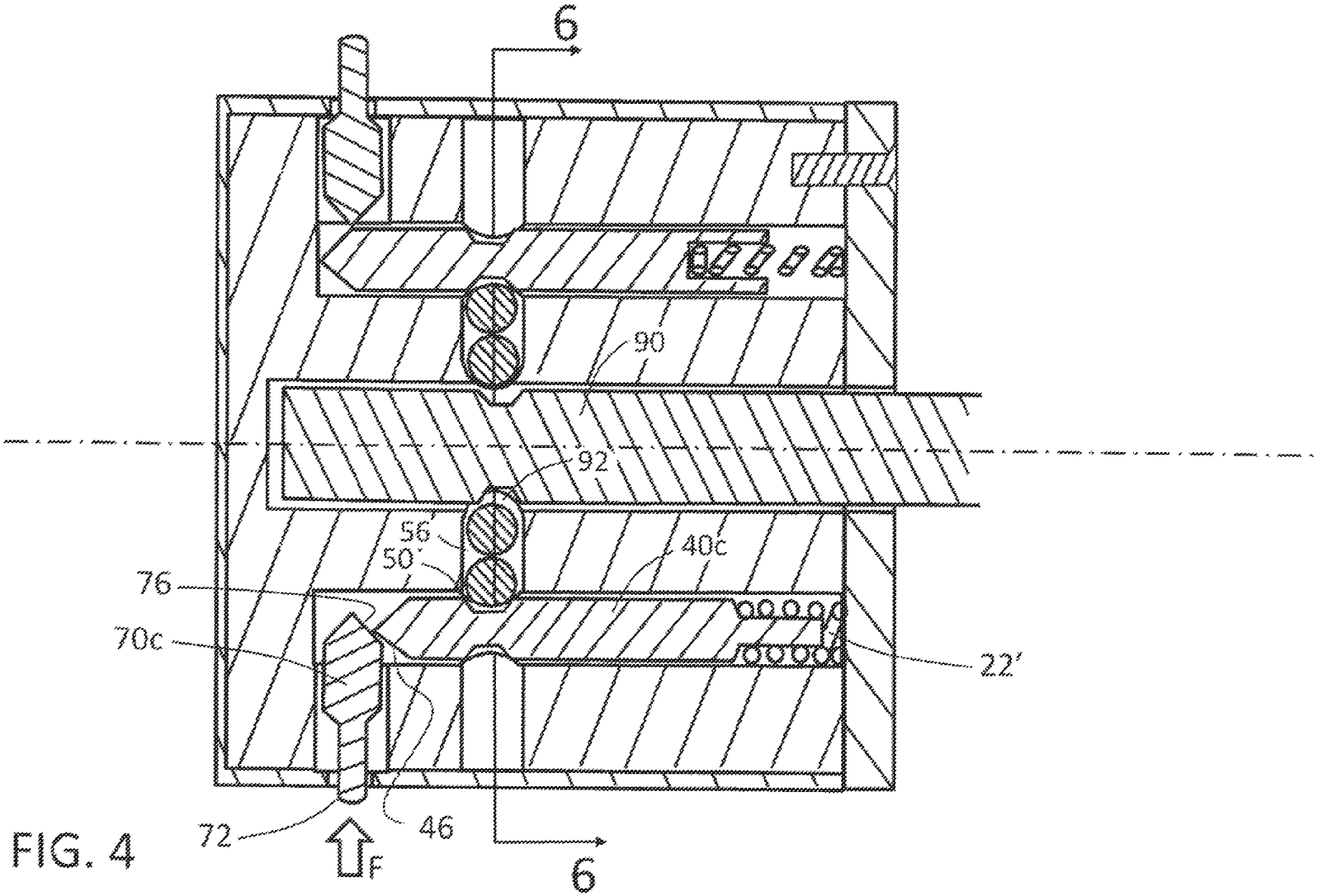
FIG. 4 shows the section view of the securement device of FIG. 3, after one of the change pins has been depressed to axially move its associated control pin.

As seen in FIGS. 3 and 4, the distal edge of the beveled surface 76 of the change pin 70 confronts the proximal edge of the beveled surface 46 (where the beveled surface 46 intersects the periphery 42 of the control pin 40). As the change pin 70*c* is depressed with a force F and moves axially into the distal end of the respective control pin bore 20, the beveled surface 76 of the change pin 70 slidingly engages the beveled surface 46 of the control pin 40, driving the control pin 40 axially toward the rear of the control pin bore 20, against the biasing force of the spring 22'. With the button 72 nearly fully depressed, the recess 50 in the control pin 40*c* aligns with the recess 92 of the post 90, termed this pin's biased unlock position, which penults the lockable device 10 to be withdrawn off of the post 90, as described in detail hereinafter.

Figure 9:
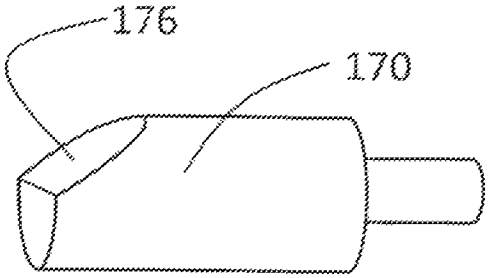
FIG. 9 shows an alternative embodiment of a change pin.

In another embodiment, the beveled surface of the change pin can be a beveled planar surface 176 through the cylindrical end, as illustrated for change pin 170 in FIG. 9. The beveled planar surface requires the change pin 170 be rotated to a position wherein the bevel surface 176 faces down the length of the control pin bore 20, in order to function as a change pin as described herein before.

The post 90 has a recess formed at distance front the distal end 94 of the post associated with each of the control pins 40. As illustrated, the plurality of recesses associated with the plurality of control pins 40 can comprise a circumferential recess 92 formed around a portion of, or the entire circumference of the post 90. The circumferential recess 92 is provided to receive tumblers 80 associated with each of the control pins 40 for securing the lockable device 10 to the post 90, as described herein after.

Figure 7:
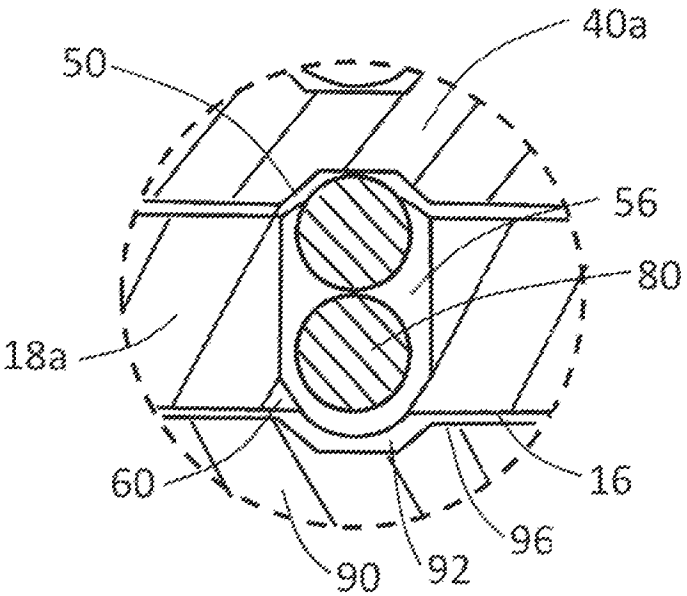
FIG. 7 shows a detailed view of a pair of tumblers in FIG. 3.

Each pin bore 20 communicates with the central bore 16 through a tumbler channel, illustrated as a cylindrical tumbler channel 56, which extends radially from, and intersects, the central bore 16 to, and with, the pin bone 20. As illustrated, tumbler channel 56 associated with each control pin 40 and each pin bore 20 is formed in the body 18 the same distance axially from the front lace 11 of the device, to standardize the lengths and features of the control pins 40, Each tumbler channel 56 is formed along a transverse or radial axis 200, perpendicular to the central axis 100. To aid in forming the cylindrical pin channels 56, an outer channel bore 58 is started through the outer periphery of the body 18, to extend radially inwardly to and through the pin bore 20, and continuing radially inwardly to the central bore 16 to form the tumbler channel 56. As can be seen in FIG. 7, the tumbler channel 56 of fixed diameter penetrates only partially (not completely) through the wall portion 18*a* that defines the central bore 16, to leave an annular shoulder 60 at the junction of the tumbler channel 56 and the central bore 16. The annular shoulder 60 defines an opening into the central bore 16 from the tumbler channel 56 that is smaller in diameter than the diameter of the tumbler channel 56, and smaller in diameter or size that the diameter (or minimum dimension) of the tumbler 80. The shoulder prevents a rambler 80 from moving completely out of the tumbler channel 56 and fully into the central bore 16 when the post 90 is withdrawn. The outer channel bore 58 also permits loading of the tumbler pints) from outside during assembly and during reprogramming of the lock device.

Figure 5:
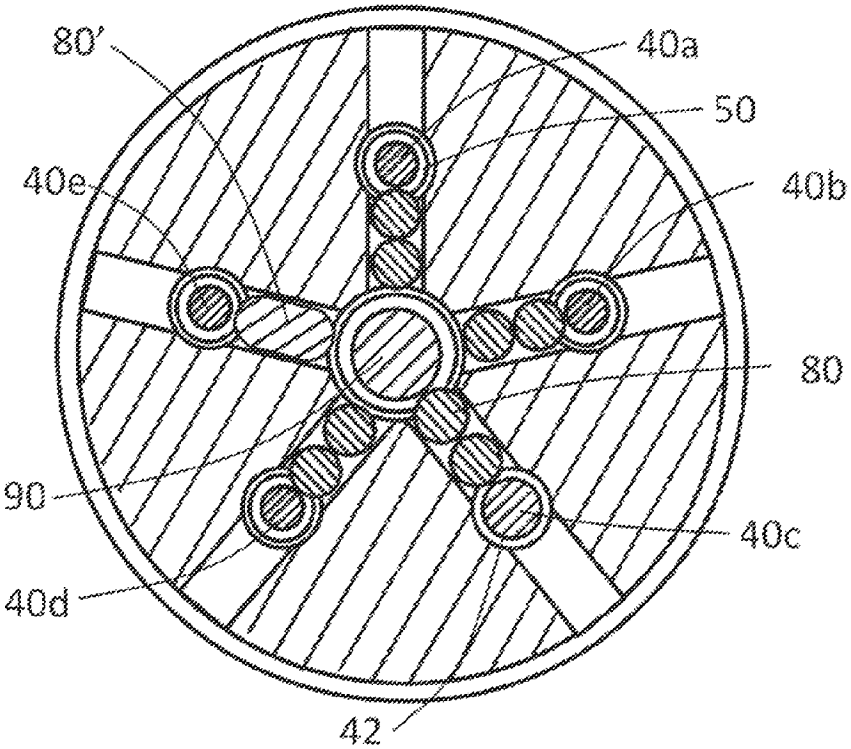
FIG. 5 shows a section view of the securement device through line 5-5 of FIG. 3, showing the position of the associated tumblers with the two control pins and associated change pins in unbiased positions.
Figure 8:
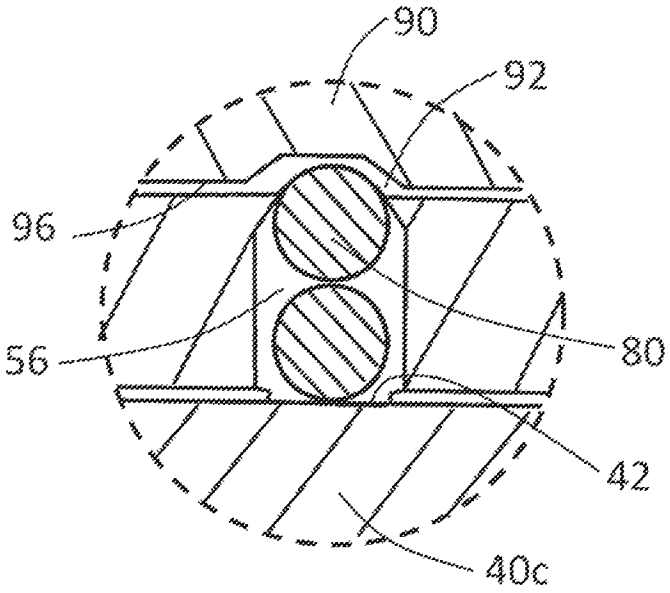
FIG. 8 shows a detailed view of another pair of tumblers in FIG. 3.

FIGS. 3 and 5 show the device 10 with all of the control pins 40 biased forwardly by the spring 22, with the distal end 44 extending forwardly. typically against the body 18 at the distal end of the pin bore 20. The distance through the wall portion 18*a* between the outer periphery of the pin bore 20 and the outer periphery of the central bore 16 is less than the dimension of the one or more tumblers 80 in total, which are accommodated by and disposed within the tumbler channel 56. Each tumbler 80 (or set of tumblers 80) disposed within each cylindrical tumbler channel 56, extends at least partially into either the central horn 16 or its respective pin bore 20, or both, since the dimension of the tumbler 80 (or set of aligned tumblers SO), from end to end, exceeds the distance of the wall portion 18 between the pin bore 20 and the central bore 16. With the post 90 disposed within the central bore 16 as shown in FIG. 3, for any one control pin 40, at least one of the groove 92 of the post 90 or the groove 50 of the control pi ft 40 is aligned with the tumbler channel 56. As also shown in FIG. 7, the circumferential groove 50 of the first control pin 40*a* and the circumferential groove 92 of the post 90 are both aligned axially with the first tumbler channel 56, such that the tumbler(s) 80 cannot be forced to reside within the annular groove 92 of the post 90, and therefore will not prevent the withdrawal of the post 90 from the lockable device 10. FIGS. 3 and 8 show that the circumferential groove 50 of third control pin 40*c* is not aligned axially with the third tumbler channel 56, which forces its tumbler(s) 80 into the annular groove 92 of the post 90. The larger circumference or diameter of the periphery 96 of the post 90 cannot clear axially past the tumbler(s) 80, which interfere with removal of the lockable device 10 from the post 90.

FIG. 5 also shows that the grooves 50 of control pins 40*a*, 40*b*, 40*d*, and 40*e* are aligned with their respective tumbler channels 56 when in their biased-forward first positions, termed these pins' neutral unlock position. Only the groove 50 of control pin 40*c* (also shown in FIGS. 3 and 8) is out of alignment axially with its tumbler channel 56 when in its biased-forward first position, termed this pin's neutral lock position, and the larger outer periphery 42 of the control pin 40 forces the tumblers 80 into the groove 92 of post 90, preventing the post 90 from being withdrawn out of its central bore 16.

Figure 6:
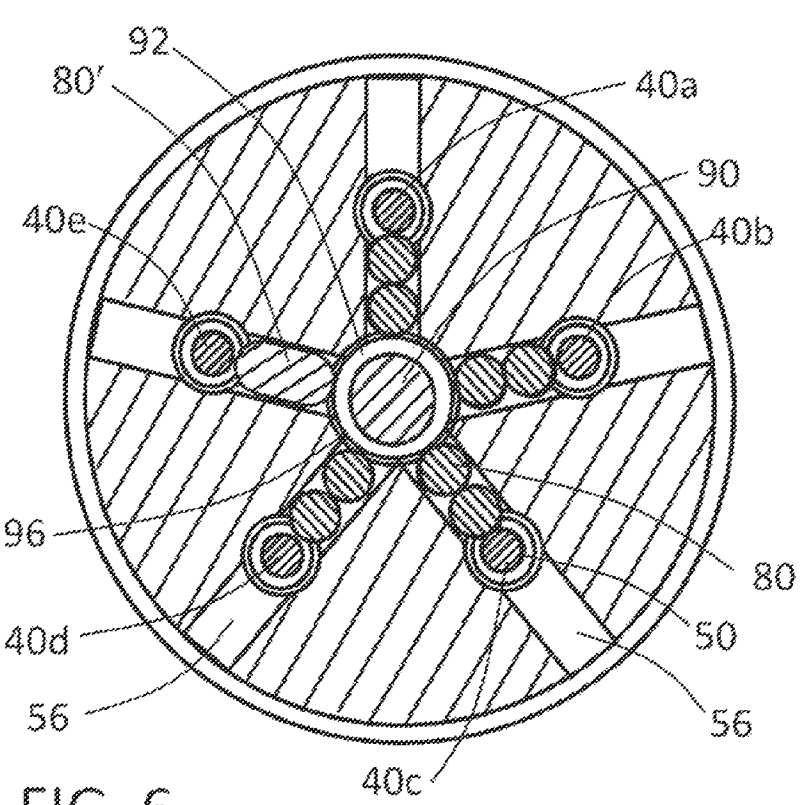
FIG. 6 shows a section view of the securement device through line 6-6 of FIG. 4, showing the position of the associated tumblers after one of the change pins has been depressed to axially move its associated control pin.
Figure 10:
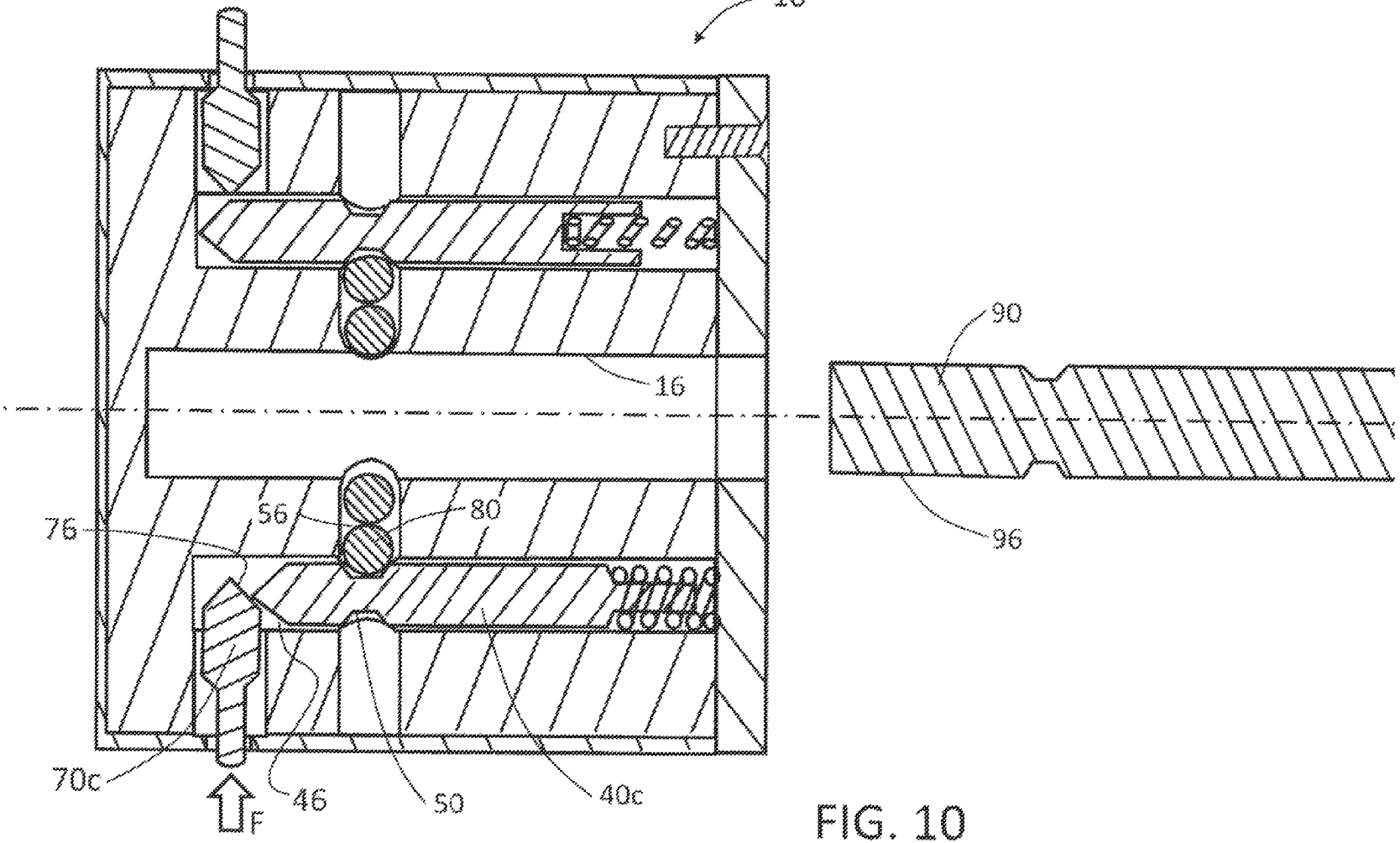
FIG. 10 shows the section view of the locking member of FIG. 6, being removed from the post.
Figure 12:
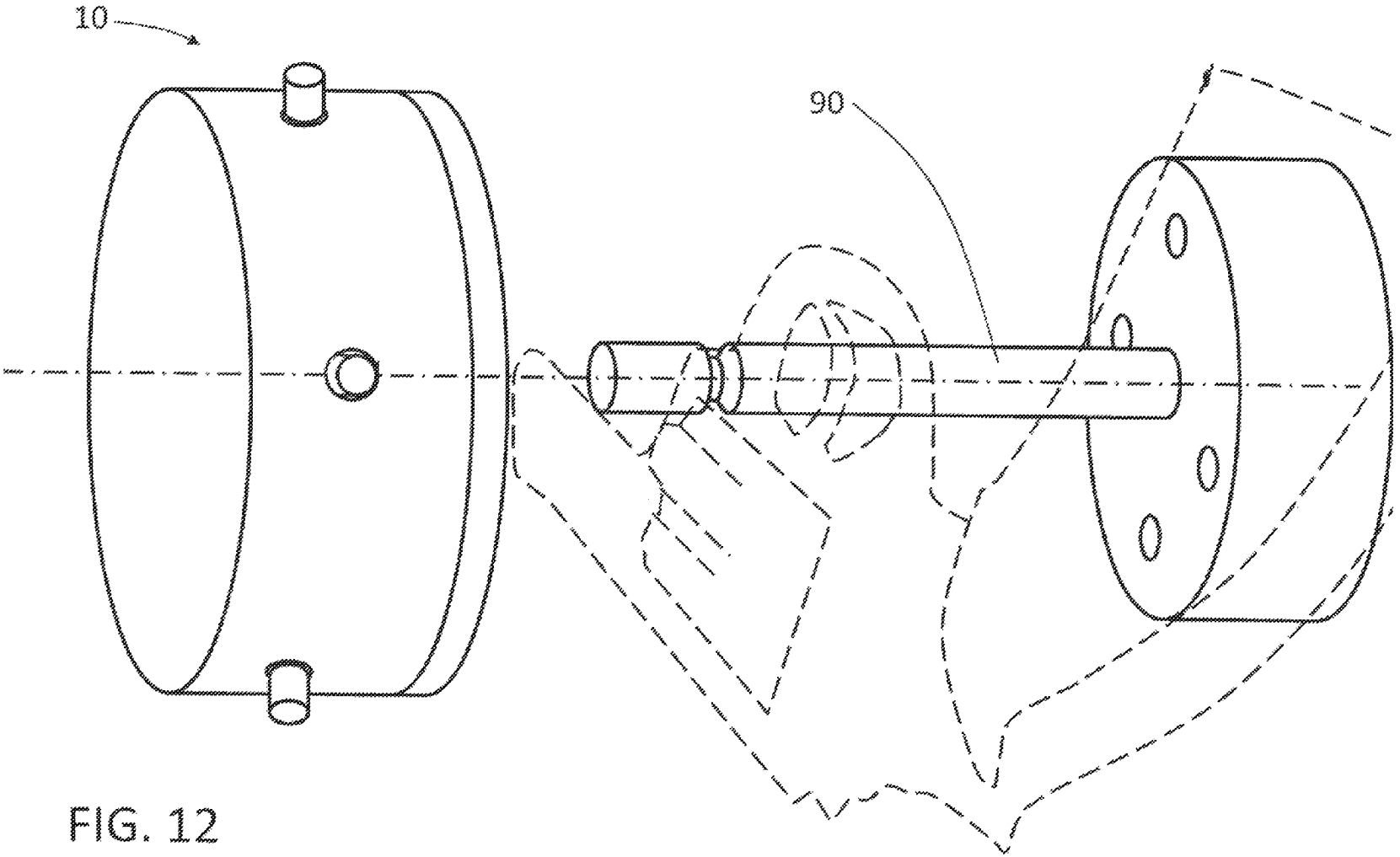
FIG. 12 shows the lock device of the invention, with the locking member removed from the post, for releasing the handgun.

FIG. 4 shows a sectional view along the axis 100 through control pin 40*a* and control pin 40*c*, after change pin 70*c* has been fully depressed by the user. The depressing of the button. 72 drives the change pin 70*c* radially inwardly to intersect the distal end of the pin bore 20, and engages the distal, edge of the beveled surface 76 of the change pin 70*c* against the proximal edge of the beveled surface 46 at the distal end 44 of control pin 40*c*, driving the control pin 40*c* axially and rearwardly, compressing the spring 22', and aligning the pin groove 50 with its tumbler channel 56, FIG. 6 provides a transverse cross sectional view through the five tumbler channels 56, showing that the groove 50 of control pin 40*c*, which has been depressed to its biased position, aligns with its tumbler channel 56. As illustrated in FIGS. 6 and 7, when both the groove 92 of the post 90 and the grooves 50 of all of the control pin 40 are aligned axially with the tumbler channel 56, then the tumbler(s) 80 will be moved, or biased out of the groove of the post 90 when an axial force is exerted against the inwardly-facing end of the tumbler 80 by the periphery 96 of the post 90. When the grooves 50 of all of the control, pins 40 are aligned axially with their respective tumbler channels 56, then the radially-Inward ends of the tumblers 80 will move out of the annular groove 92 of the post 90 and substantially fully into the tumbler channel 56, and the lockable device 10 can be withdrawn off of the post 90, as illustrated in FIG. 10. As FIG. 12 also illustrates, the apparatus or article, shown as a handgun, mounted on the post 90 (typically with the post disposed behind the trigger), can be removed from the post 90 after the locking member 10 is removed.

It can be understood that, once the radial force F is withdrawn from the button 72 of the radial change pin 70, the compression spring 22 (or 22') expands axially and drives the control pin 40 back toward the distal end of the control pin bore 29, which in reverse causes the beveled surface 46 of the control pin 40 to engage the beveled surface 76 of the change pin 70, and drives the change pin 70, and its button 72, radially outwardly within the change pin bore 74.

The tumbler(s) 80 are illustrated as spherical balls, allowing than to roll and move easily along the tumbler channels 36 and into and out of the grooves. Alternative tumblers can include an elongated cylindrical tumbler 81 with rounded ends as illustrated in FIGS. 5 and 6 for the tumbler 80' associated with control pin 40*e*. Tumblers 80 can have any other shape and size that spontaneously is biased from a groove 92 of the post 90 when an axial force is applied against the tumbler 80 by the peripheral edge of the groove.

The grooves 50,92 of the control pins 40 and the post 90 are configured and designed to allow the selected, tumbler 80 to be biased outward from the post's groove 92 merely by axial movement of the post 90 against the tumbler 30, The grooves 50, 92 are illustrated as circumferential rectilinearly-formed troughs having tapered sides. The groove can also have just a rectangular trough, or a curved (parabolic) groove, or a V-shaped groove Typically the depth of the groove 50,92 from the outer periphery of the control pin 40 or post 90 is less than the radius of a spherical tumbler.

Figure 11:
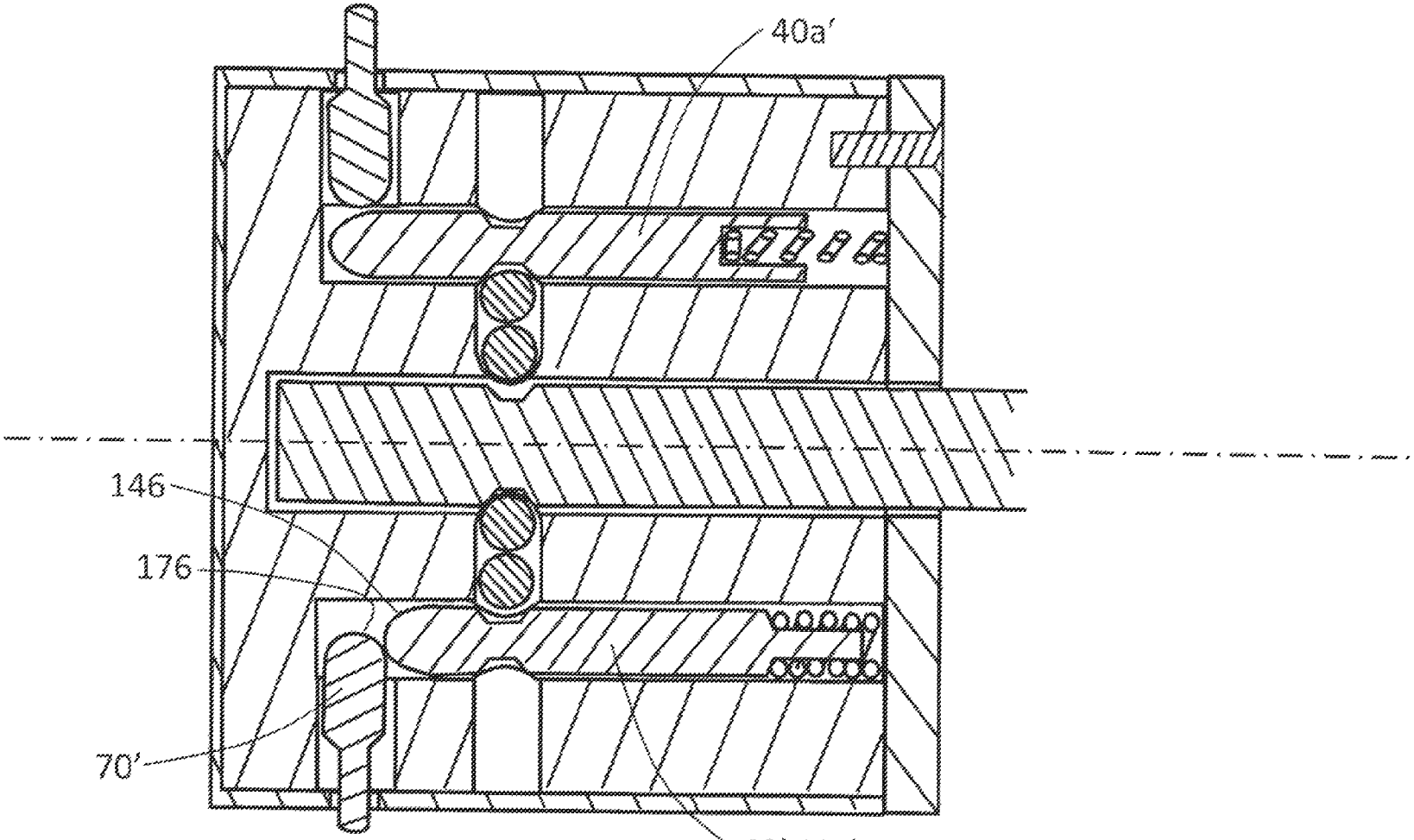
FIG. 11 shows a section view of an alternative embodiment of the locking member.

FIG. 11 shows an alternative embodiment, wherein the distal end of the control pin 40' has a rounded surface 146, as opposed to a planar beveled surface or conical surface, likewise, the distal end of the change pin 70' has a rounded surface 176, as opposed to a planar beveled surface or conical surface. The distal ends of the control pin 40' and the change pin 70' can both be rounded, both be beveled, or one can be rounded and one can be beveled.

It can be understood that numerous other lock combinations are available among the five (5) pins of the first embodiment. It is presumed that at least one of the five control pins 40 is in a neutral lock position. Combinations for a five-control-pin locking member can include any one pin in a neutral lock position (5 combinations), any two pins (10 combinations), any three pins (10 combinations), any four pins (5 combinations), and all five pins (1 combination), for a total of 31 combinations. The lockable device 10 is both installed onto the post 90, and removed from the post, by depressing and holding the programmed combination of buttons 72, which moves and keeps each of the grooves 50 of the control pins 40 in alignment axially with their respective tumbler channels 56, allowing the tumblers 80 to move clear of the post groove 92.

Figure 13:
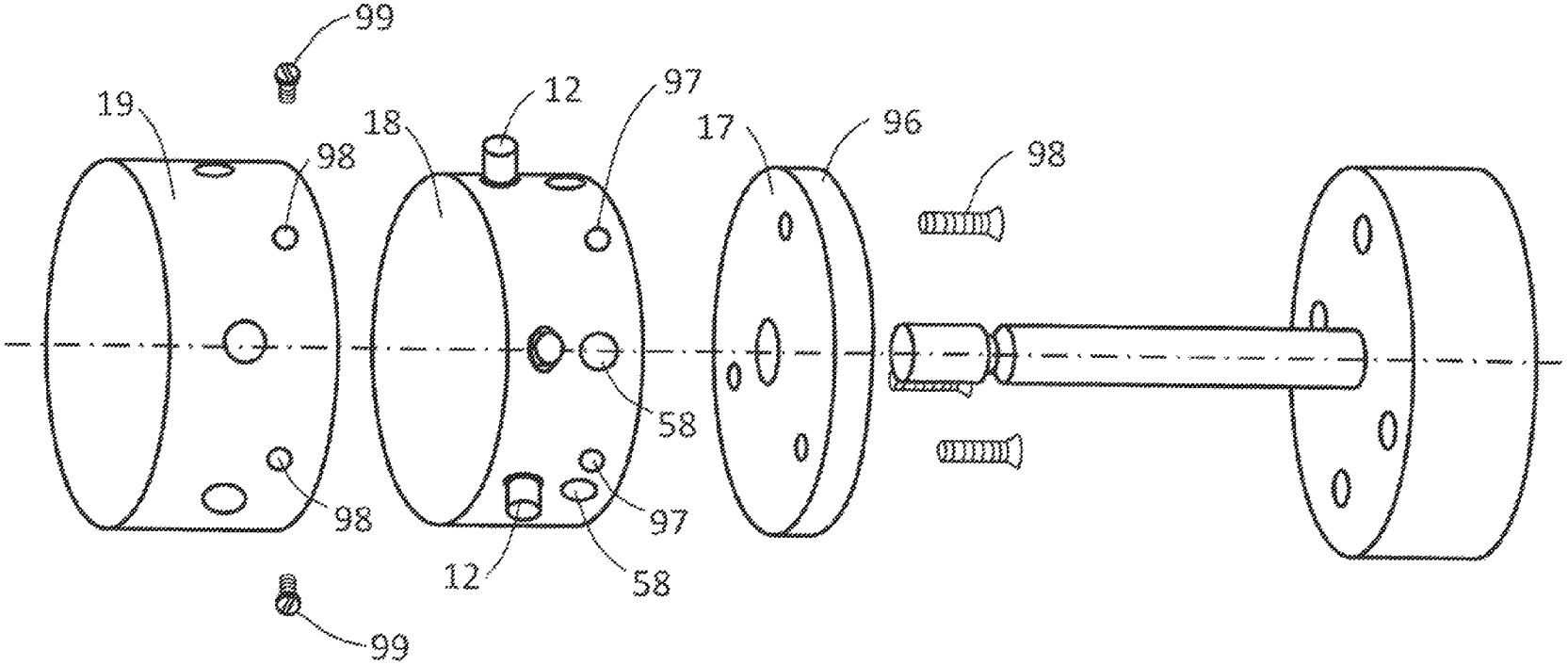
FIG. 13 shows an exploded view of the elements of the lock device.

FIG. 13 shows an exploded view of the lockable device, post and base of the first embodiment of the gun lock system. A back plate 96 is secured to the rear of the cylindrical body 18, using fasteners, such as threaded screws 98 threaded into threaded bores 94 (FIG. 3) in the rear face of the body 18. A cylindrical cap 19 fits over dig outer cylindrical body 18, and seats against a peripheral flange portion 17 (see also FIG. 3) of the back plate 96. Screws 99 inserted through openings 98 secure the cap 19 into threaded bores 97 in the peripheral wall of the body 18.

Figure 14:
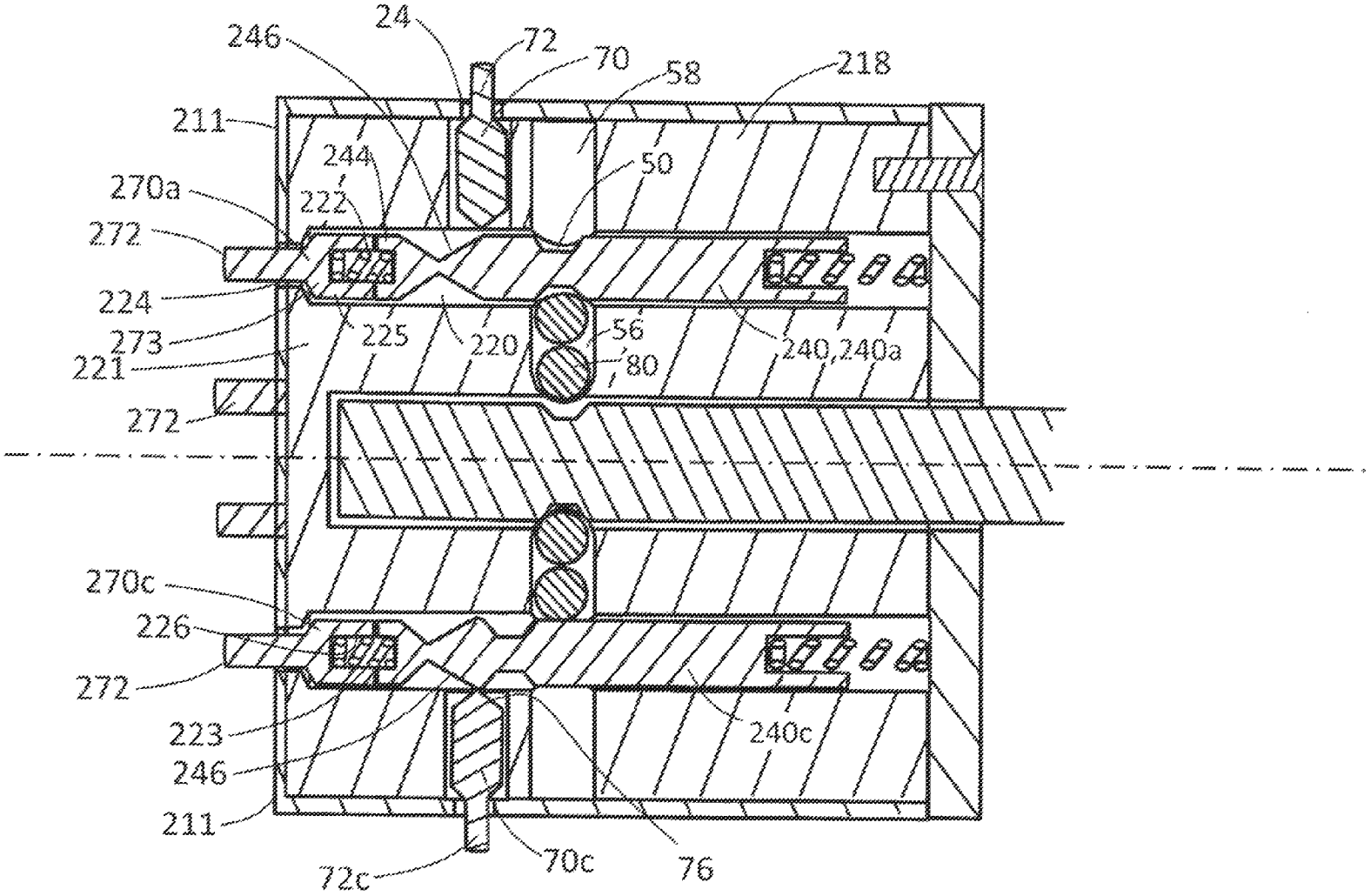
FIG. 14 shows a section view of a second embodiment of a locking member, illustrating two control pins and associated radial and axial change pins in unbiased positions.

FIGS. 14-15 illustrate another embodiment of the invention, wherein the push-button locking member 10 includes a plurality of axially-extending depressable change buttons 272 extending through the face of the lock body 18, in addition to the plurality of radially-extending change buttons 72. Each axially-extending change button 272 extends from an axial change pin 270 disposed, in a distal end of the control pin bore 220, which extends to the front face 221 of the lock body 218. The control pin 240 includes a body having a periphery along its length and in cross section, illustrated as a cylindrical body having a periphery 42, and distal first end 244, which is biased to a biased-forward first position, toward the distal end of the control bore 220, by the spring 22 acting against tire second end 48. A recess 50 is formed into the periphery 42 intermediate the distal first end 244 and second end 48. As illustrated, the recess 50 can extend around the entire circumference of the control pin 240 to form a circumferential recess. The recess 50 and its center are disposed a selected fixed distance from the first end 244 of the control pin 240. The control pin 240 also includes a beveled surface 246, disposed between the distal end 244 and the recess 50 as illustrated. (In an alternative embodiment, the beveled surface 246 can be disposed between the recess 50 and the second end 48.) The distal, first end 244 of the control pin 240 is configured to seat and secure the opposed distal end of a compression spring 222 within recess 226. The spring force of spring 222 is typically less than that of spring 22.

Each axial change pin 770 includes a body having a drive end 225, and an opposed push-button end that includes the reduced-diameter button 272 that extends from a shoulder 273, and through an opening 224 in the front wall 211. The drive end 225 of the axial change pin 270 is configured to seat and secure the opposed distal end of the compression spring 222 within its recess 226. In its spring-biased position, the distal, end 244 of the control pin 240 engages and is driven into and against the drive end 225 of the axial change pin 270 by compression spring 22, to bias the reduced-diameter button 272 outward within the opening 224 in the front wall 211.

The control pin 240, the axial change pin 270, and the radial change pin 70 cooperate wherein if either the button 272 of the axial change pin 270 is depressed axially, or button 72 of the radial change pin 70 is depressed radially, the control pin 240 is driven axially toward the rear of the control pin bore 220, against the biasing force of the spring 22.

Figure 15A:
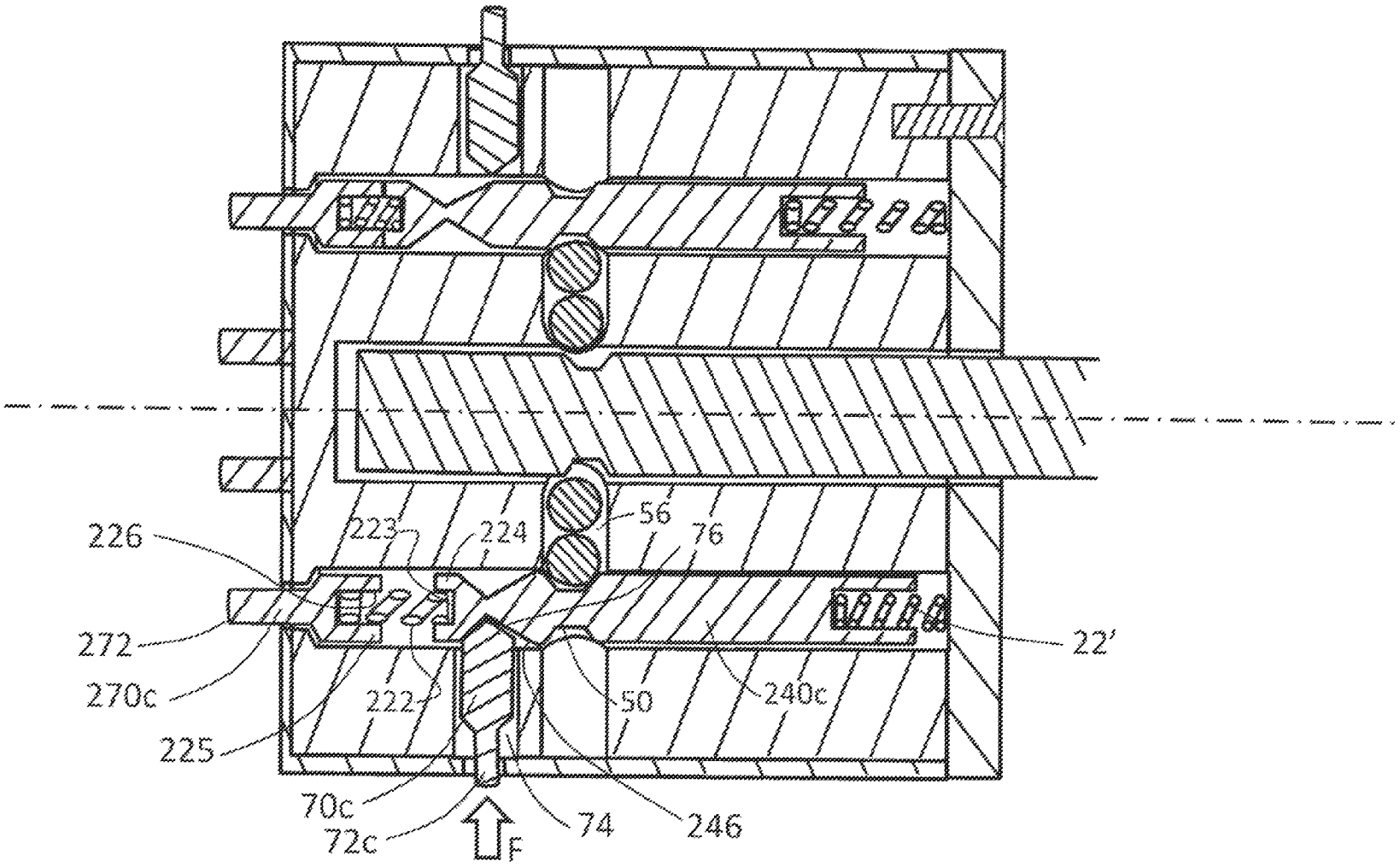
FIG. 15A shows the section view of the securement device of FIG. 14, after one of the radial change pins has been depressed to axially move its associated control pin.

As illustrated in FIG. 15A, depressing button 72*c* of radial change pin 70*c* causes its beveled surface 76 to engage the beveled surface 246 of the control pin 240*c* and drive the control pin 240*c* axially and rearwardly. As illustrated, simultaneously, the compression spring 222 expands rearwardly while remaining its seating within the recess 223 of the distal end 244 of the control pin 240, with, compressive force sufficient to continuously drive forwardly the axial change pin 270*c*, such the button 272 of the axial change pin 270*c* remains forwardly-extending from the front face 211, even while the control pin 240 is moved rearwardly. It can be understood that, once the radial force F is withdrawn from, the button 72 of the radial change pin 70*c,* the compression spring 22' (or 22) expands axially and drives the control pin 240 toward the distal end, which in reverse causes the beveled surface 246 of the control pin 240 to engage the beveled surface 76 of the change pin 70, and drives the change pin 70*c,* and its button 72, radially outwardly and overcomes and compresses the compression spring 222, until the distal end 244 engages the drive end 225 of the axial change pin 270*c.*

Figure 15B:
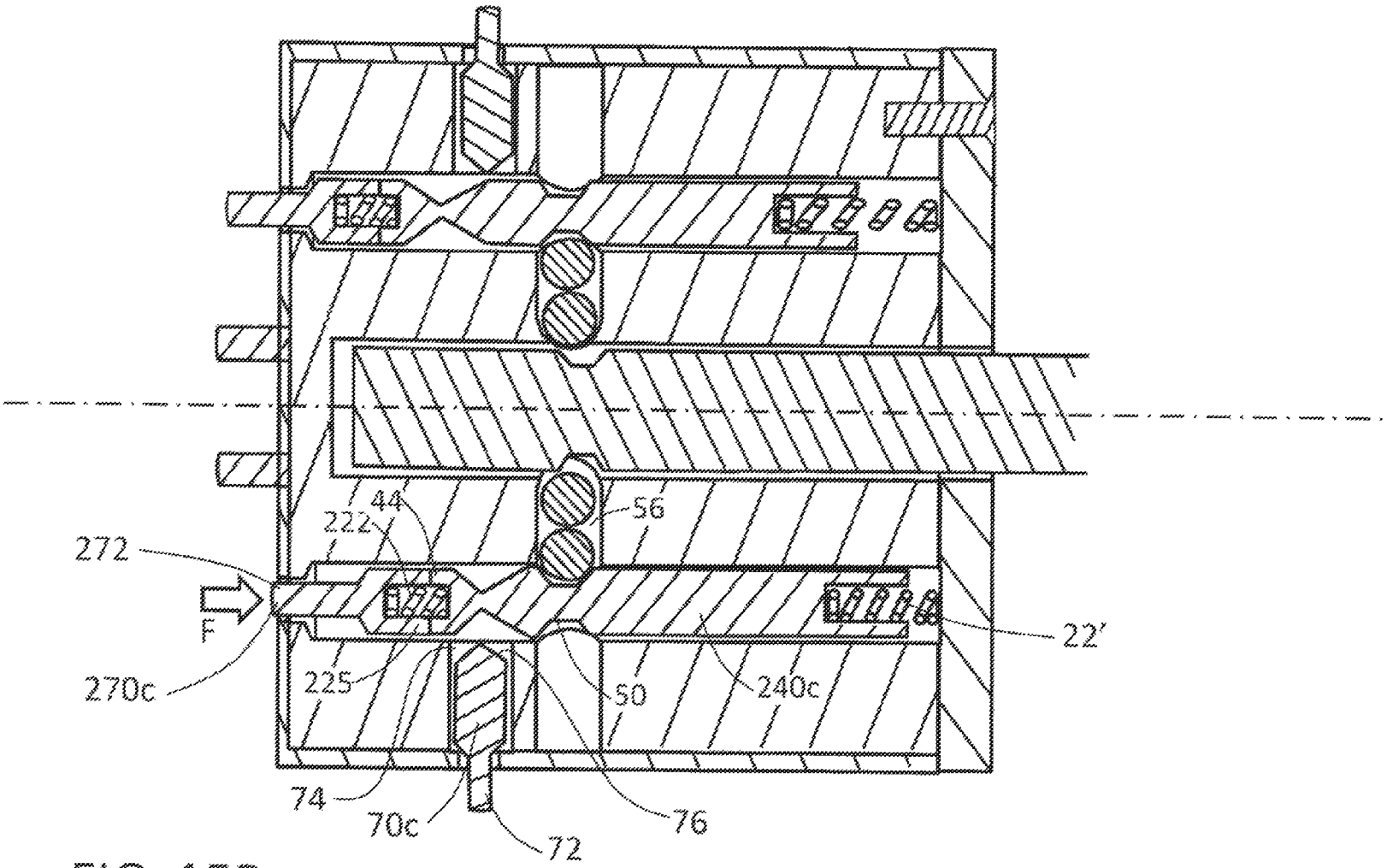
FIG. 15B shows the section view of the securement device of FIG. 14, after one of the axial change pins has been depressed to axially move its associated control pin.
Figure 16:
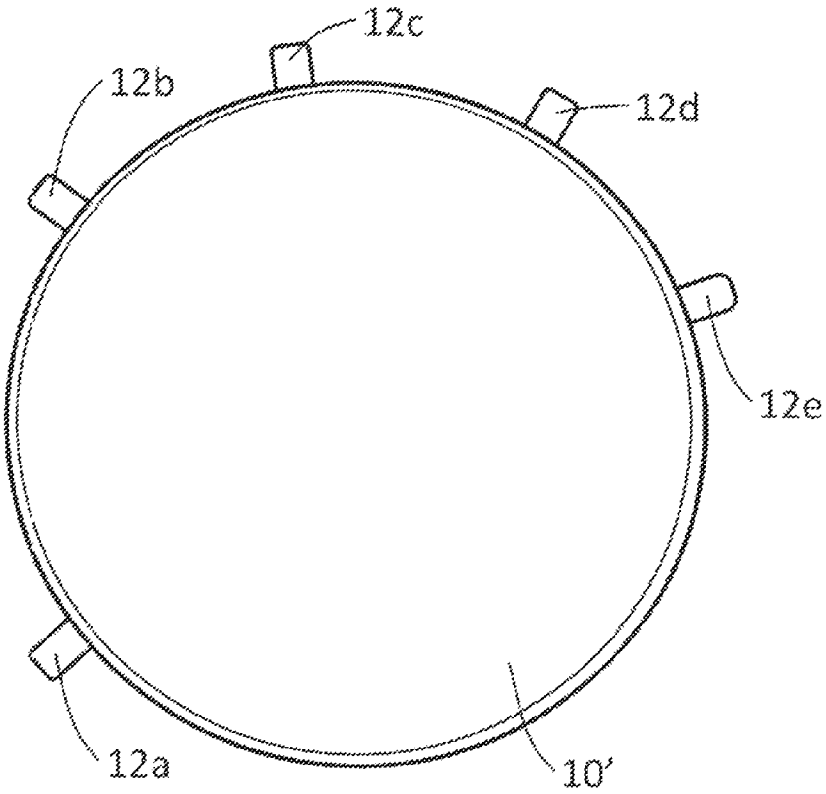
FIG. 16 shows a front view of a securement device with the five change pin buttons disposed in particular positions.

Alternatively, as illustrated in FIG. 15B, depressing the button 272 of axial change pin 270*c* causes its drive end 225 to drive the control pin 240 axially and rearwardly. As illustrated, the radial change pin 70 floats within its radial bore 76, it cart be understood that, once the axial three P is withdrawn from the axial button 272 of the axial change pin 270, the compression spring 22' expands axially and drives the control pin 40 toward the distal end, which in reverse drives the axial change pin 270, and its button 272, axially forwardly, It can also be understood that the shape of the body of the lockable device, though illustrated as cylindrical, can be other shapes, including square, rectangular, oval, polygonal, and other irregular shape in cross section, and along its axis. Similarly, the post bore can be made, in cross section, in other shapes than cylindrical, including square rectangular, oval, and polygonal, with the one or more post grooves in the periphery, or a continuous peripheral groove, with the tumbler channels extending outwardly, including radially outwardly, to the associated pin bores. The post bore can also be positioned in other positions axially into the body of the lockable device, other than centrally, including off center, along a periphery of the body, etc. The pin bores as well can arranged in a pattern that follows the periphery of the post bore, or can be in any pattern provided, the tumbler channels can extend to the periphery of the post bore, FIG. 16 illustrates that a locking member 10' with the afore-illustrated five change pins, and their extending buttons 12, can be arranged at selected positions circumferentially along the peripheral wall 14. In the illustrated embodiment, the five buttons 12 can simulate the positions of the human digits, wherein the user's thumb would engage the button 12*a,* while the remaining lingers—index, middle, ring and little fingers—would engage the remaining buttons 12*b,* 12*c,* 12*d* and 12*e,* respectively.

Figure 17:
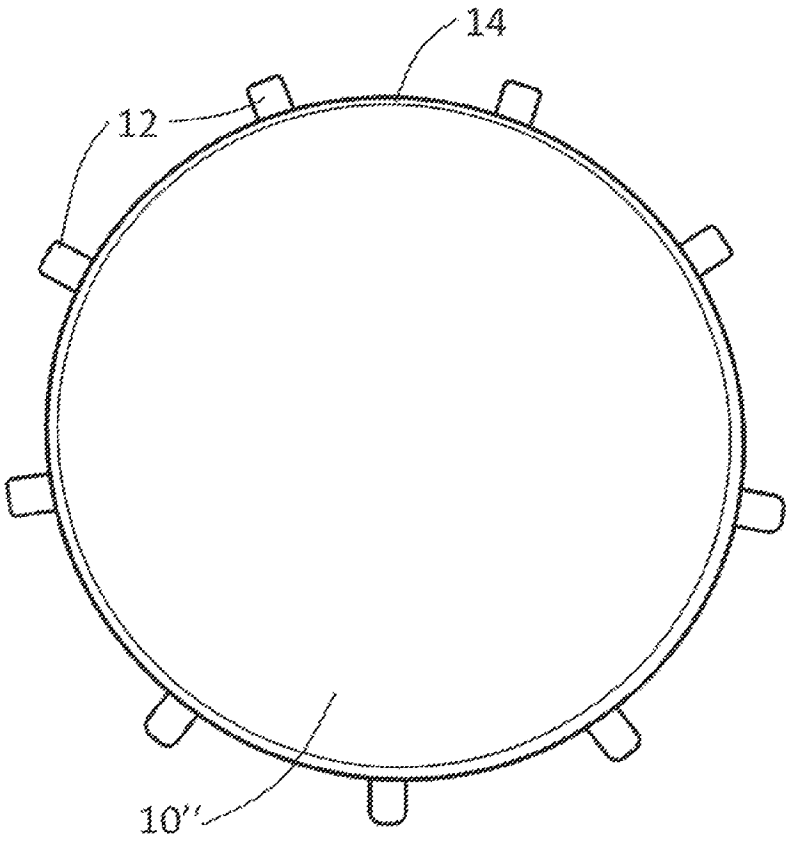
FIG. 17 shows a front view of another securement device having nine control pins and associated change pins, with the change pin buttons in circumferentially evenly-spaced positions.

FIG. 17 illustrates an embodiment of the locking member that includes 9 equally spaced control plus and buttons 12 circumferentially along the peripheral wall 14.

The components of the locking member and securing member of the invention can be made of any mechanical fabrication material, and in particular any durable, non-bendable or bend-resistant material (with the exception of parts that are intended to bend with resilience, sock as springs), Non-limiting examples of the material are metal and alloys, including but not limited to steel, stainless steel, iron, aluminum, brass, copper, bronze, and others, wood, plastics including but not limited to acrylic, polycarbonate, PVC and other well-known durable plastics, ceramics, etc.

I claim:

1. A lock device for securing an article, including;

a locking member that locks to a securing member, the securing member including a post having a groove along a circumference of the post, the locking member including a body having an axis, a front face, and a rear face, and a sidewall, the body having a post bore along the axis and through the rear face that is configured to accept the distal end of the post, a plurality of pin bores displaced from the post bore, a plurality of radial tumbler channels extending between each pin bore and the post bore, a plurality of change pin bores, each change pin bore intersecting one of the plurality of pin bores, and a plurality of button openings in the sidewall, each button opening in communication with one of the plurality of change pin bores;

a change pin disposed in each change pin bore, the change pin having a body, a first end having a slanted surface, and including a button at a second end disposed within one of the plurality of button openings in the sidewall of the body, the change pin moveable within the change pin bore between a first position biased toward the sidewall, and a second depressed position when the button end is depressed wherein the first end extends into the corresponding one of the plurality of pin bores;

a control pin disposed in each pin bore, the control pin having a body, a first end and an opposed second end, the first end having a slanted surface, and having a control pin recess formed in the body intermediate the first end and second end, the control pin moveable within the pin bore between a first position biased toward the front face, and a second depressed, position disposed rearwardly from the first position; and a tumbler disposed within each tumbler channel, configured for radial movement within the tumbler channel within at least one of the groove of the post when disposed within the post bore, and the control pin recess, wherein when the change pin is depressed to its second depressed position, the slanted surface of the change pin slidingly engages the slanted surface of the control pin, and biases the control pin to its second depressed position.

2. The lock device according to claim 1 wherein the tumbler consists of two or more balls.

3. The lock device according to claim 1 wherein the control pin body is cylindrical and the control pin recess is a circumferential recess.

4. The lock device according to claim 1 wherein the change pin bores are bored through the sidewall of the body, and further including a cylindrical cover secured to the body, and having a sidewall having the button openings in alignment with the change pin bore.

5. The lock device according to claim 1 further including a spring within each control pin bore at the second end of the control pin that biases the control pin toward the front face.

6. The lock device according to claim 1 wherein the side button opening has a reduced diameter relative to the diameter of the change pin bore.

7. The lock device according to claim 1 further including a plate secured to the rear face of the locking device that extends radially outwardly from the outer periphery of the locking device.

8. The lock device according to claim 1 wherein the body of the locking member has a slot extending axially and inwardly from the post bore into the body of the lock member, and the post includes an axially-arranged rib extending along its periphery for registry with the slot, as a means for preventing relative rotation of the body about the post.

9. The lock device according to claim 1 wherein the slanted surface is selected from the group consisting of a slanted line, a beveled surface, and a curved surface.

10. A lock device for securing an article, including:

a locking member that locks to a securing member, the securing member including a post having a groove along a circumference of a distal end of the post.

the locking member including a body having an axis, a front face, and a rear face, and a sidewall, the body having a post bore along the axis and through the rear face that is configured to accept the distal end of the post, a plurality of pin bores displaced from the post bore, a plurality of radial tumbler channels extending between each pin bore and the post bore, a plurality of change pin bores, each change pin bore intersecting one of the plurality of pin bores, a plurality of front button openings in the front face of the lock member, each face button opening in communication with one of the plurality of pin bores, and a plurality of side button openings in the sidewall, each side button opening in communication with one of the plurality of change pin bores;

a radial change pin disposed in each change pin bore, the radial change pin having a body, a first end having a slanted surface, and a second end disposed within one of the plurality of button openings in the sidewall of the body, the change pin moveable within the change pin bore between a first position toward the sidewall, and a second depressed position wherein the first end extends into the corresponding one of the plurality of pin bores;

a control pin disposed in each pin bore, the control pin including a body having a first end and an opposed second end, a control pin recess formed intermediate the first end and second end, and a slanted surface formed intermediate the first end and control pin recess, the control pin moveable within the pin bore between a first position biased toward the front face, and a second depressed position disposed rearwardly from the first position;

an axial change pin having a first end and an opposed second end, the first end including a button that extends through the front button opening in the front face of a lock member; a button spring disposed in compression between the first end of the control pin and the second end of the axial change pin; and a tumbler disposed within each tumbler channel, configured for radial movement within the tumbler channel within at least one of the groove of the post when disposed within the post bore, and the control pin recess, wherein when the radial change pin is depressed to its second depressed position, the slanted surface of the radial change pin slidingly engages the slanted surface of the control pin to bias the body of the control pin to its second depressed position, and when the button of the axial change pin is depressed, the second end of the axial change pin drives the body of the control pin to its second depressed position.

11. The lock device according to claim 10 wherein the second end of the axial change pin captures a first end of a change spring, and the first end of the body of the control pin captures a second end of the change spring.

12. The lock device according to claim 10 wherein the tumbler consists of two or more balls.

13. The lock device according to claim 10 wherein the control pin body is cylindrical and the control pin recess is a circumferential recess.

14. The lock device according to claim 10 wherein the change pin bores are bored through, the sidewall of the body, and further including a cylindrical cover seemed to the body, and having a sidewall having the button openings, wherein the change pin bores are bored through the sidewall of the body, and further including a cylindrical cover secured to the body, and having a sidewall having the button openings in alignment with the change pin bore.

15. The lock device according to claim 10 further including a spring within each control pin bore at the second end of the control pin that biases the control pin toward the front face.

16. The lock device according to claim 10 wherein the side button opening has a reduced diameter relative to the diameter of the change pin bore.

17. The lock device according to claim 10 further including a plate secured to the rear face of the lock device that extends radially outwardly from the outer periphery of the locking device.

18. The lock device according to claim 10 wherein the body of the locking member has a slot extending axially and inwardly from the post bore into the body of the lock member, and the post includes an axially-arranged rib extending along its periphery for registry with the slot, as a means for preventing relative rotation of the body about the post.

19. The lock device according to claim 10 wherein the slanted surface is selected from the group consisting of a slanted line, a beveled surface, and a curved surface.

* * * * *